US011524330B2

(12) United States Patent
Thorsten et al.

(10) Patent No.: US 11,524,330 B2
(45) Date of Patent: Dec. 13, 2022

(54) METHOD FOR PRODUCING A HOLLOW VALVE FOR INTERNAL COMBUSTION ENGINES

(71) Applicant: FEDERAL-MOGUL VALVETRAIN GMBH, Barsinghausen (DE)

(72) Inventors: Matthias Thorsten, Garbsen (DE); Antonius Wolking, Barsinghausen (DE); Guido Bayard, Dortmund (DE)

(73) Assignee: Federal-Mogul Valvetrain GmbH, Barsinghausen (DE)

( * ) Notice: Subject to any disclaimer, the term of this patent is extended or adjusted under 35 U.S.C. 154(b) by 0 days.

(21) Appl. No.: 17/437,782

(22) PCT Filed: Jan. 30, 2020

(86) PCT No.: PCT/EP2020/052227
§ 371 (c)(1),
(2) Date: Sep. 9, 2021

(87) PCT Pub. No.: WO2020/182365
PCT Pub. Date: Sep. 17, 2020

(65) Prior Publication Data

US 2022/0152690 A1 May 19, 2022

(30) Foreign Application Priority Data

Mar. 12, 2019 (DE) ..... 10 2019 106 222.5

(51) Int. Cl.
*B21K 1/22* (2006.01)
*B21D 22/16* (2006.01)
*B21J 7/14* (2006.01)

(52) U.S. Cl.
CPC ..... *B21K 1/22* (2013.01); *B21D 22/16* (2013.01); *B21J 7/14* (2013.01)

(58) Field of Classification Search
CPC ..... B21K 1/22; B21D 22/16; B21J 7/14
See application file for complete search history.

(56) References Cited

U.S. PATENT DOCUMENTS 6,006,713 A 12/1999 Gebauer
2009/0020082 A1 1/2009 Suzuki et al.
(Continued)

FOREIGN PATENT DOCUMENTS

CN 104791040 A 7/2015
DE 102010051871 A1 5/2012
(Continued)

OTHER PUBLICATIONS

Bolzoni et al., Understanding the properties of low-cost iron-containing powder metallurgy titanium alloys, Materials and Design, Aug. 3, 2016, Elsevier Ltd, pp. 317-323 (Year: 2016).*

*Primary Examiner* — David P Bryant
*Assistant Examiner* — Christine Bersabal
(74) *Attorney, Agent, or Firm* — Robert L. Stearns; Dickinson Wright, PLLC

(57) ABSTRACT

The invention relates to a method for producing a valve body for a hollow valve. Said method comprises the following steps: providing a workpiece, blank or semi-finished product and a forming punch, introducing a protective layer between the workpiece and the forming punch (22) and press forming the workpiece to produce a preform. The invention also relates to a hollow valve produced by means of this method.

8 Claims, 3 Drawing Sheets

(56) References Cited

U.S. PATENT DOCUMENTS

| | | | | |
|---|---|---|---|---|
| 2012/0246934 | A1 | 10/2012 | Morii et al. | |
| 2014/0366373 | A1* | 12/2014 | Morii | F01L 3/14<br>29/888.451 |

FOREIGN PATENT DOCUMENTS

| | | | | |
|---|---|---|---|---|
| DE | 102015118495 | A1 | | 5/2017 |
| EP | 0898055 | A1 | | 2/1999 |
| EP | 2325446 | A1 | | 5/2011 |
| GB | 543573 | | * | 3/1942 |
| GB | 543573 | A | | 3/1942 |
| JP | S63109210 | | | 5/1988 |
| JP | 1995102917 | A | | 4/1997 |

* cited by examiner

METHOD FOR PRODUCING A HOLLOW VALVE FOR INTERNAL COMBUSTION ENGINES

BACKGROUND

1. Technical Field

The present invention relates to a method for producing hollow valves, or cavity valves, for internal combustion engines, and to hollow valves produced using said method.

2. Related Art

Intake and outlet valves are thermally and mechanically highly stressed components in internal combustion engines. Sufficient cooling is therefore necessary to ensure the long-term operability of the valves. Herein, hollow head valves are advantageous over solid stem valves and hollow stem valves (i.e. a hollow valve in which a cavity is provided only in the stem), as a cavity is present both in the stem and in the valve head, which makes it possible to achieve improved internal cooling by means of a cooling medium, e.g. sodium. Further advantages are lower weight, the avoidance of hot spots (in the combustion engine) and reduction of CO2.

Hollow valves are usually produced by a combination of different methods, e.g. forging, turning and welding. Herein, turning or milling the cavity is particularly cost-intensive. Welding points on the plate surface or at other operationally critical points should also be avoided. Another disadvantage of known methods is that they often require a large number of method steps, as is the case in EP 2325446 A1, e.g. However, fast deforming processes are advantageous for a cost-effective production of large quantities.

For example, EP 0898055 A1 and U.S. Pat. No. 6,006,713 A describe a hollow head valve, which is produced by closing a hollow blank by means of welding (friction welding, laser welding) or plating. Other publications dealing with the production of hollow valves are CN 104791040 A and JP 1995102917.

This production, however, experiences major wear problems due to the high-alloy valve steel. Very high wear occurs on the tool during the production of the valve preform, in particular on the forming punch. This means a short service life and high tooling costs.

Known methods for producing hollow valves with non-uniform interior stem geometry are represented in US 20090020082 with the use of inserts over the drilled plate surface and in DE 102010051871 A1 with the production by means of an ECM method.

A problem underlying the present invention therefore is to provide a method for producing hollow valves or a valve body for hollow valves, which does not have the aforementioned disadvantages and at the same time has high productivity, good material utilization and fast deforming processes.

Another problem underlying the present invention is to adapt the production method such that the wear on the tool is reduced.

SUMMARY

The method for producing a valve body of a hollow valve comprises the steps of providing a workpiece, i.e. a blank or semi-finished product, and a forming punch, and inserting a protective coating between workpiece and forming punch, as well as compressive forming of the workpiece for generating a preform.

According to an aspect of the present invention, prior to inserting a protective coating, a step of generating a cavity in the workpiece can be performed, into which cavity the protective coating is inserted.

According to an aspect of the present invention, the generation of the cavity and/or the compressive forming can be performed by means of hot forming.

According to an aspect of the present invention, the protective coating may consist of powder.

According to an aspect of the present invention, the powder may comprise Ti—Fe or iron oxide.

According to an aspect of the present invention, the powder can be heated to 1050-1200° C.

According to an aspect of the present invention, the protective coating can comprise a powder or a powder combination to increase the cooling effect of a valve plate bottom of the valve body, which combines with the valve plate to form a cooling layer.

According to an aspect of the present invention, a valve stem and a valve head with a valve plate and a valve plate bottom can be formed in a further method step, either by means of compressive forming or following the compressive forming, in particular by means of impact extrusion or forging.

According to an aspect of the present invention, the stem diameter can be further reduced by means of necking, swaging, flow forming or axial feed transverse rolling of the preform with or without mandrel after the spin extrusion in a further method step by means of cold, semi-hot or hot forming.

An additional method for producing a valve body of a hollow valve comprises the steps of providing a workpiece, i.e. a blank or a semi-finished product, and the spin extrusion of the workpiece for generating a preform having a bowl with a hollow shape formed by the bowl wall.

According to an aspect of this additional method, the spin extrusion can be performed by means of a forming punch, which is pressed against the workpiece with an axial force, and at least one forming roller, which is pressed onto the workpiece with a radial force.

According to an aspect of this additional method, the preform may have a valve head/plate and a valve stem with a reduced stem diameter compared to the valve plate.

According to an aspect of this additional method, the at least one forming roller can be arranged opposite the forming punch such that its radial force is applied between the tip and a thickest diameter, or in between them.

According to an aspect of this additional process, the workpiece can be accommodated in a workpiece holder on a spindle and rotate about its longitudinal axis, and the forming punch turns synchronously to the spindle.

According to an aspect of this additional method, the at least one forming roller and the forming punch synchronously perform an axial movement.

According to an aspect of this additional method, the method can be carried out as cold, semi-hot or hot forming process.

According to an aspect of this additional method, the stem diameter can be further reduced by means of necking, swaging, flow forming or axial feed transverse rolling of the preform after the spin extrusion in a further method step.

According to an aspect of this additional method, the cross-section of the hollow form may be circular or have a driver profile such as a body of constant width, ellipse, polygon, or axial-oriented splined and gearing profiles.

According to an aspect of this additional method, forming the valve head can be performed after the spin extrusion by means of impact extrusion or forging of the valve head in a further method step.

According to the invention, the problem is further solved by a hollow valve comprising a valve body which was produced using the aforementioned method.

BRIEF DESCRIPTION OF THE DRAWINGS

In the following, exemplary embodiments of the invention are described in more detail with reference to the drawings, in which.

Figures 1A, 1B, 1C, 1D, 1E, 1F:
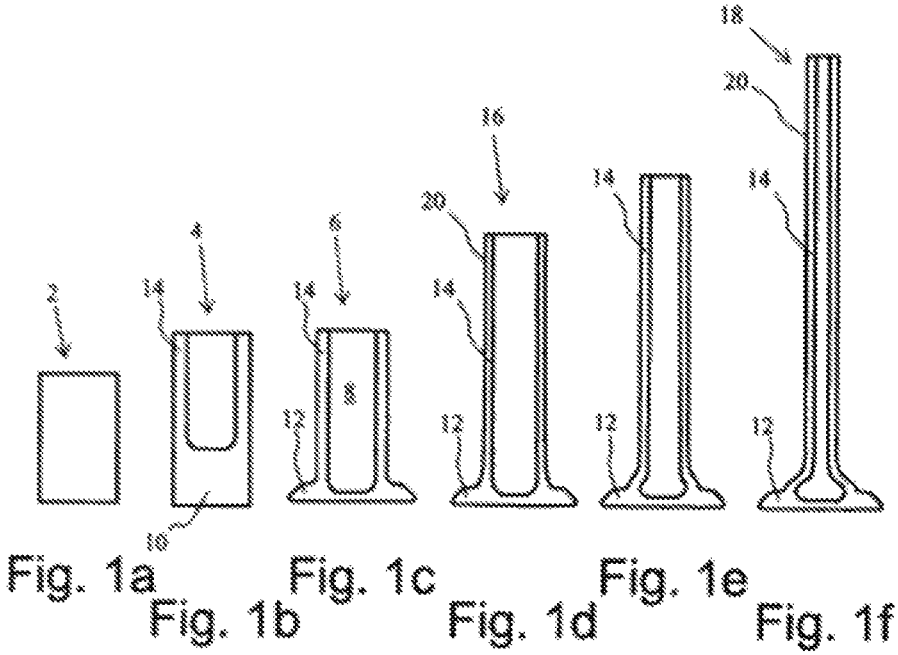
FIGS. 1*a*-1*f* show various intermediate steps of the production of a valve body of a hollow valve from a blank.

In the following, identical reference signs are used both in the description and in the drawing for identical or similar elements or components. Furthermore, a list of reference signs list is included, which applies to all drawings. The embodiments shown in the drawings are merely schematic and do not necessarily represent the actual proportions.

DETAILED DESCRIPTION

FIG. 1A to 1F are sectional views of different intermediate stages of the production method according to an embodiment of the invention, wherein optional or preferred production steps/intermediate stages are also shown.

Preferably, a blank 2 made of valve steel known to the person skilled in the art serves as a starting point, see FIG. 1*a*. The blank has an at least partially cylindrical shape, preferably a circular cylindrical shape, corresponding to the circular shape of the valve body or valve to be produced.

The blank 2 is deformed into a bowl-shaped semi-finished product (or workpiece) 4 shown in FIG. 1*b*. The semi-finished product 4 in the shape of a bowl comprises a bottom section 10, from which a valve head (or valve plate) 12 is later formed, and a tubular wall (or annular wall) 14, which surrounds a cylindrical, preferably circular cylindrical, cavity 8 of the bowl-shaped semi-finished product 4 and from which a valve stem 20 is later formed. Herein, material may flow between the bottom section 10 and the tubular wall 14 during the subsequent deforming steps.

Instead, the bowl-shaped semi-finished product 4 can be provided directly; the method then starts with providing the bowl-shaped semi-finished product 4 shown in FIG. 1*b*.

In a subsequent deforming step, the valve head 12 is formed from the bottom section 10. A preform 6 of the valve body obtained in this manner is shown in FIG. 1*c*.

Both the deforming of the blank 2 into a bowl-shaped workpiece 4 and the forming of the valve head 12 from the bottom section 10 can be performed by means of a hot or cold forming method, for example. Impact extrusion or forging is preferably used. In impact extrusion, a punch is pressed into the blank 2 or the semi-finished product 4 to form the cavity 8 or the valve head 12, i.e. it is essentially a reverse extrusion or transverse extrusion (of a bowl). The preform 6 can also be formed directly from the blank 2 in a single deforming step, e.g. by means of forging or impact extrusion.

In the next processing step, from FIG. 1*c* to FIG. 1*d*, an axial length of the tubular wall 14 is increased. 'Axial' refers here to the direction defined by the tubular wall 14 (i.e. the future stem), i.e. to the (centre) axis of the tubular wall; 'radial' correspondingly is a direction orthogonal to the axial direction. Thus, a length of the tubular wall 6 is measured in the axial direction.

For this purpose, the flow forming or cylinder flow forming process can be performed on a flow-forming mandrel 22. During the flow forming process, the preform rotates and at least one forming roller 24, 26, which rotates along by means of frictional engagement, is pressed against the outside of the tubular wall and moved in the axial direction, such that it causes the plastic shape to change. The associated incremental deforming leads to an advantageous work hardening of the machined steel. Overall, the wall thickness of the tubular wall decreases while at the same time the axial length of the tubular wall increases. If necessary, the at least one forming roller is displaced several times in the axial direction until the desired length increase or wall thickness reduction is achieved. In this case, the radial distance of the at least one forming roller from the axis of the tubular wall is successively reduced during consecutive passes.

Due to the flow-forming mandrel 22 used therein, the flow forming process essentially results in an elongation of the tubular wall 14, wherein the outer diameter of the same decreases a little (corresponding to the decrease in wall thickness). If a larger decrease in the outer diameter is desired, it is also possible to perform a flow forming process with multiple forming rollers without flow-forming mandrel.

If dimensions of the preform 6 and parameters of the flow-forming process are selected such that the length of the tubular wall 14 achieved by means of the flow forming process, the outer diameter achieved by means of the flow forming process, and an inner diameter of the tubular wall 14 of the preform (which corresponds to a diameter of the flow-forming mandrel) correspond to the desired dimensions of the hollow valve to be produced, a valve body 16 for a hollow stem valve can be obtained in this way (see FIG. 1*d*, wherein it should be noted that the relative dimensions shown in the drawings do not have to correspond to the actual relative dimensions; in particular, in FIG. 1*d*, the diameter of the valve plate/head is represented smaller in relation to the stem diameter than it would be in a typical actual valve; likewise, the stem diameter in relation to the length of the stem 20 is represented larger than usual).

Finally (from FIG. 1*d* via FIG. 1*e* to FIG. 10, the outer diameter of the tubular wall 14 is optionally reduced to obtain a finished valve body 18 for a hollow head valve, the valve stem 20 of which has a predetermined outer diameter, i.e. has a desired target diameter; cf. FIG. 1*f*. This deforming step is preferably carried out without the mandrel being installed, such that the diameter can be effectively reduced. In addition to a reduction in the outer diameter, this step also leads to a further elongation of the tubular wall 14 and, if carried out without a mandrel, to an increase in the wall thickness of the tubular wall 14. If necessary, the wall thickness would therefore be adjusted slightly smaller in the preceding flow forming step to obtain a specific wall thickness, and thus a specific inner diameter at a given outer diameter D, taking into account the thickness increase in the final step.

The reduction of the outer diameter of the tubular wall 14 can be carried out by swaging or necking (diameter reduction by constriction), wherein swaging is preferred. In the case of swaging, it is important that no further deforming step of the valve body 18 for a hollow head valve takes place after the swaging to reduce the outer diameter of the tubular wall 14, as this would worsen the positive material properties obtained by swaging. Thus, swaging is the final deforming step in this case.

Swaging is an incremental compressive deforming process in which the workpiece to be machined is hammered in rapid succession from different sides in a radial direction. Due to the resulting pressure, the material 'flows', so to speak, and the material structure is not distorted by tensile stresses. Swaging is preferably carried out as a cold deforming process, i.e. below the recrystallisation temperature of the processed material. Thus, a significant advantage of the use of swaging as a final deforming step is that compressive stresses are induced during swaging by the radial application of force, whereby the occurrence of tensile stresses, which increase the susceptibility to cracks, is prevented; this applies in particular to the surface layers of the hollow stem. Swaging thus works together with the preceding, also incremental deforming process of flow forming in an advantageous manner, such that optimal material properties, e.g. strength, can be achieved.

Further advantages of swaging as a final deforming step—compared to extrusion processes or necking—are a better possible surface quality and a comparatively greater diameter reduction of the stem per step. Due to the high possible surface quality and the fact that the tolerances which can be maintained during swaging are very low, a post-processing of the valve stem is usually not necessary. Free deforming processes or compression processes—such as necking—generally only result in a worse surface quality or wider tolerance ranges. Accordingly, no further method step for reducing the outer diameter of the tubular wall should be carried out particularly by means of extrusion or necking after swaging.

To complete the production process of the hollow valve, a cooling medium, e.g. sodium, can be filled into the cavity of the valve body via the outwardly open end of the valve stem, and subsequently this end of the valve stem can be closed, e.g. by a valve stem end piece, which is attached, for example, by means of friction welding or another welding process (not shown in the drawings).

The reduction of the outer diameter can be carried out in multiple partial steps (an intermediate step is shown, for example, in FIG. 1*e*), wherein the individual partial steps can be carried out either with or without mandrel (at the beginning of a partial step, the diameter of a mandrel may be smaller than the diameter of the cavity); a diameter of the mandrels can also be reduced in successive partial steps.

Figure 2B:
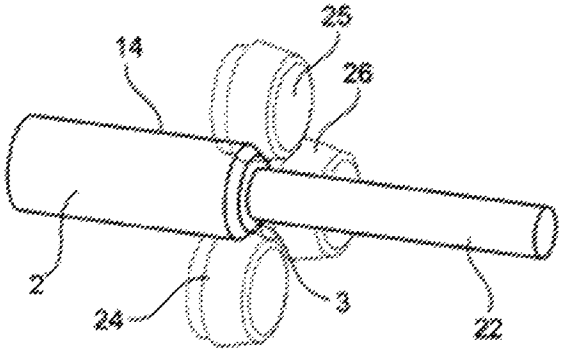
FIGS. 2*a*, 2*b*, 2*c* show a method step of the spin extrusion in a 3D view.
Figure 2C:
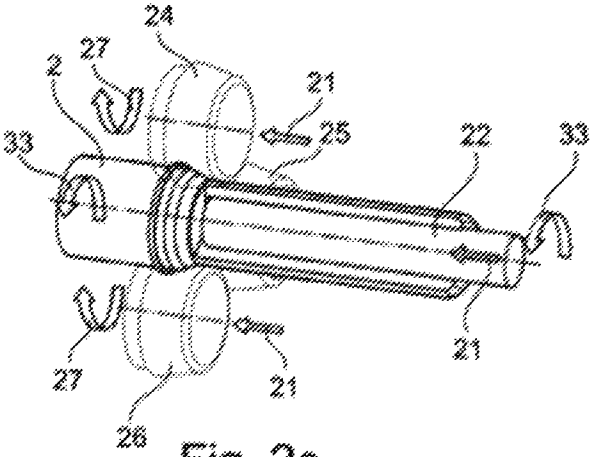
Figure 2A:
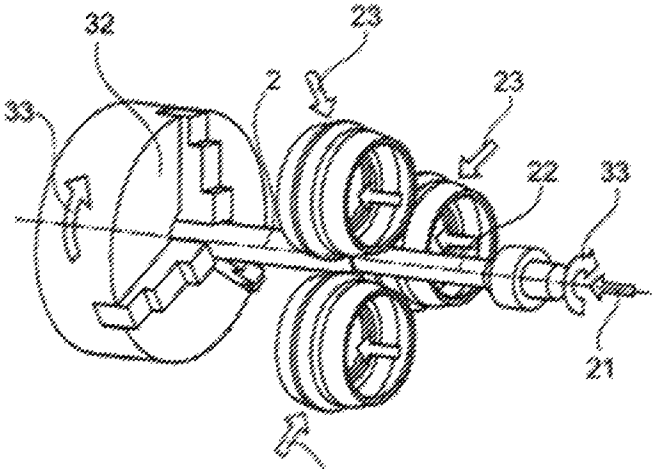

FIGS. 2*a*, 2*b* and 2*c* represent the method step of spin extrusion, which takes place between FIG. 1*a* or FIG. 1*b* and FIG. 1*c*, in a 3D view.

In an optional first step, a hollow space is introduced into the blank 2, at the point of the blank 2, where the later cavity 8 is to be created. This serves to create and centre the forming punch 22 on the blank 2 or to simplify the following production step. Thus, a workpiece is created as a semi-finished product 4 with cavity, as shown in FIG. 1*b*. The workpiece for spin extrusion can thus be an unprocessed blank 2 or a semi-finished product 4.

As shown in FIG. 2*a*, the workpiece 2, 4 is inserted into a workpiece holder 32 and clamped in a spindle of a lathe or automatic lathe.

The actual step of spin extrusion begins with the attachment of the forming punch 22 (and the forming rollers 24, 25, 26) centrically to the front side 3 of the workpiece 2, 4, as shown in FIGS. 2*a* and 2*b* (in a magnified view). A preform 6 can be produced directly from the rod material 2 in a single method step. This preform may then have a valve plate 12 and a valve stem 20 with a reduced stem diameter compared to the valve plate. The stem diameter of this preform 6 may be greater than that of the finished valve.

To produce the preform 6, the spindle displaces the workpiece 2, 4 in a rotation 33 about its longitudinal axis. Therein, the forming punch 22, which can also be described as a compression punch or flow-forming mandrel, may rotate along with the workpiece 2, 4, e.g. by frictional engagement or by means of a drive. Alternatively, the forming punch 22 can also not rotate, but only move axially. In the latter case, it would be expected that a lot of heat is generated. If the three forming rollers 24, 25, 26 (synchronised forming rollers), which are arranged equidistant to each other, are pressed against the side wall 14 of the workpiece 2, 4 by a radial force 23 to be applied, they move about their axes (not about the rotational axis of the spindle 33) in a rotation 27 due to frictional engagement. The rotational direction 33 of the workpiece 2, 4 together with the workpiece holder 32 and (optionally) the forming punch 22, and the rotational direction 27 of the forming rollers 24, 25, 26 are indicated in the drawing by curved arrows.

The arrangement of forming punch 22 and the forming rollers 24, 25, 26 is moved uniformly and synchronously in the axial direction in the direction of the spindle. Alternatively, the workpiece 2, 4 can be moved against the tool arrangement. This leads to a plastic deformation of the workpiece 2, 4. The forming rollers and the axially acting forming punch work simultaneously. The forming punch 22 penetrates centrically into the workpiece and forms a tubular wall 14 of a bowl with an inner diameter corresponding to the outer diameter of the forming punch 22. The outer diameter of the tubular wall 14 is limited by the forming rollers 24, 25, 26. In addition, they simultaneously carry out a step of stretch forming by compression or rolling. The excess, displaced material of the workpiece 2, 4 flows away, such that the length of the tubular wall 14 increases in the axial direction (reverse extrusion of a bowl). The translational directions of movement 21 of the forming punch 22 and the forming rollers 24, 25, 26 are indicated by arrows in the drawing. The flow direction of the material of the tubular wall 14 is opposite to these.

FIG. 2 shows three forming rollers 24, 25, 26 by way of example, while it is also possible to use only one, two or more than three forming rollers. If multiple forming rollers are used, these are preferably evenly distributed across the circumference; i.e. with two push rollers, the angle (in the circumferential direction) between the push rollers is about 180°, with three pressing rollers about 120°, etc. As a result, the preform 6 is supported in particular in all directions and transverse forces on the workpiece 2, 4 are avoided.

In an extended arrangement (not shown in the drawings), there is a radial and an axial offset between the forming rollers 24, 25, 26. Radial offset means that the radial distance of each forming roller 24, 25, 26 from the centre axis is different. Due to the axial offset of the forming rollers 24, 25, 26, the forming roller 24 closest to the workpiece strikes the workpiece 2, 4 first and modifies it, while more distant forming rollers 25, 26 impact the workpiece later, i.e. the places that have already been modified by the previous forming roller 24. Thus, the thickness of the tubular wall 14 can be stretch-formed gradually. Consequently, the forming roller 24 closest to the workpiece must have the greatest radial distance from the centre axis for the first stretch forming step, followed by the one with the second greatest radial distance, etc. In this manner, the method can be accelerated, as multiple radius or wall thickness reduction steps can be carried out in one pass. Instead of radial offsetting forming rollers of the same diameter, it also is possible to use forming rollers with different diameters.

Eliminating an axial offset of the forming rollers 24, 25, 26 (a radial offset would be pointless in this case), on the other hand, reduces transverse and torsional forces on the workpiece, which would be caused by axially offset rollers.

Alternatively, multiple sets (not shown) of forming rollers can be arranged. The forming rollers of each set 24, 25, 26 are arranged without offset. The sets are spaced apart in the axial direction and each set causes a partial stretch forming of the workpiece 2, 4. As a result, transverse and torsional forces on the workpiece are reduced/avoided compared to flow forming with a radial/axial offset, while the advantage of a gradual stretch forming and lower flow forces in the material of the workpiece is still realized.

The spin extrusion may result in a semi-finished product 4 with a bowl forming a cavity 8 (see FIG. 1*b*). However, the valve head 12 can also be produced simultaneously during this processing step. For this purpose, the distance of the rotational axes 27 of the forming rollers 24, 25, 26 from the rotational axis 33 of the workpiece 2, 4 must be adjustable, such that the thickness of the tubular wall 14 resulting from axially displacing the tool arrangement is variable and a contour with a valve head 12 (as shown in FIG. 1*c*) can be produced. As a special feature, it should be noted that the valve bottom 10 is produced either by cutting the workpiece with another tool (chisel) or, optionally, by tightly clamping the workpiece, such that the valve bottom 10 is generated from the bottom of the workpiece. Furthermore, it should be noted that the forming punch 22 should no longer move synchronously with the forming rollers 24, 25, 26 on the last piece, if applicable, in order not to create a continuous cavity 8 instead of a blind bore.

Advantageously, the spin extrusion process results in high productivity, good material utilization, low expenditure of time during the production, and a continuous deforming method. Material savings of up to 90% compared to deep-hole drilling can be achieved. At the same time, an undesired welding seam on the surface of the valve plate 12 is avoided.

Partial bulk forming methods, such as spin extrusion, are characterized by the fact that the material is not plasticized in the entire deforming volume, but in temporally and spatially limited increments. For this reason, a reduction in the punching force is possible compared to the reverse extrusion process for generating a bowl shape, while still being able to achieve about four times the length-to-diameter ratio.

Due to the high hydrostatic pressure component, the method is particularly suitable for high-strength materials. The tools used for spin extrusion have a low shape memory.

Figure 3:
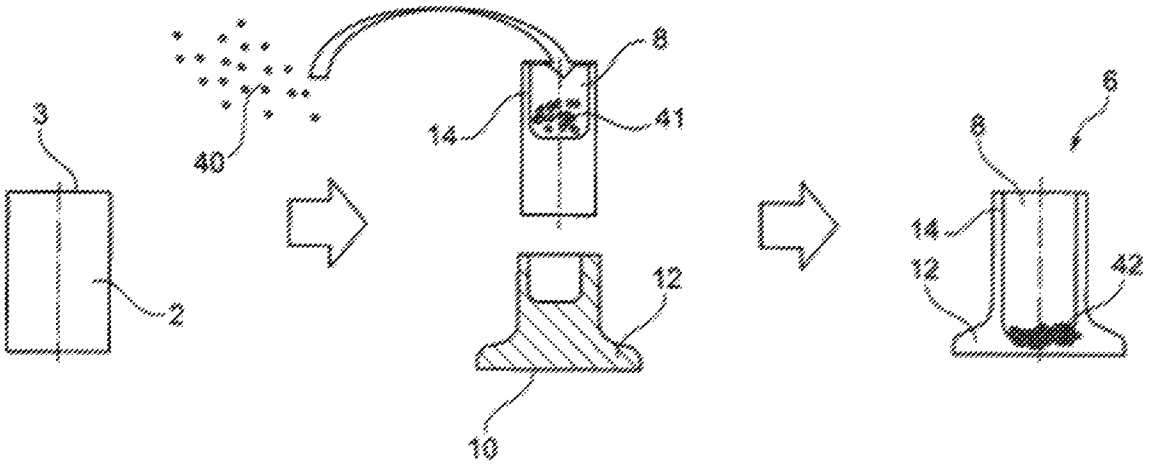
FIG. 3 shows an application of a protective coating during the production.

FIG. 3 shows an idea which can be applied to almost all types of impact extrusion under pressure. A protective coating 41 between tool 22 and workpiece 2, 4 is produced during machining. Such a protective coating 41 turns into a liquid film under the pressure between tool 22 and workpiece 2, 4 and reduces the wear that would otherwise be caused by the radial outflow of the material on the front surface of the forming punch 22, which is subject to an axial force. The punch thus comes into contact only with the powder 40 (or its liquid phase) in the region of the points with the greatest risk of wear. The forming punch 22 is shielded from the material of the workpiece. As a result, high wear can be avoided and a longer service life of the tool and higher cost-effectiveness of the manufacturing process can be achieved.

Optionally, the method can be carried out in two stages. In that case, a hollow space with a cavity 8 is formed in a blank 2 or slug in a first step, in particular is forged, in particular by means of hot forming. The cavity can have different shapes. In a second step, a protective coating 41 is introduced into the cavity. Alternatively, without executing the first step described above, a protective coating 41 can also be applied directly onto the contact surface between blank 2 and forming punch 22. For example, the material of the protective coating can be held in place by an appropriate die, which, for example, prevents the material from flowing out laterally.

Powder 40, in particular one made of the alloy Ti—Fe or iron oxide, can be used as the starting material of the protective coating 41, which is filled into the cavity or applied to the surface 3 of the blank 2.

After this preparation, the forging process can take place, in particular the extrusion process, in particular by means of hot forming, to produce the preform 6 (see also FIG. 1*c*). For this purpose, the workpiece is heated before the forging step, usually to a temperature of 1050-1200° C., depending on the base material of the valve. During such a hot forming process, the powder 40 liquefies and bonds, thus forming a (liquid) protective coating 41 between forming punch 22 and workpiece 2, 4.

This liquefied protective coating 41 hardens again during cooling and bonds to the workpiece, i.e. this special protective coating 42 remains in the finished valve.

Therefore, other powder combinations instead of Ti—Fe are also conceivable in order to increase the cooling effect of the valve plate bottom 10 by means of a cooling layer 42 in the finished valve.

Subsequently, the process chain is continued, e.g. the wall thickness 14 of the bowl can be reduced, as described in the description of FIG. 1, and an elongation of the bowl can be achieved.

Different preforms 6 with different hollow shapes can be produced by shaping the moulding tool (forming punch 22). For example, the cross-section of the hollow form may be circular or have a driver profile such as a body of constant width, ellipse, polygon or axial-oriented splined and gearing profiles.

In particular, the method of providing the protective coating 41 can offer special advantages for the low-wear production using the extrusion method of spin extrusion described above, because simultaneously generating the cavity 8 by means of the forming punch 22 and applying pressure from the outside by means of the forming rollers 24, 25, 26 means that the tool load is higher than with conventional methods. Therefore, the low level of wear and tear is particularly (but not exclusively) important for this method.

The invention claimed is:

1. A method for producing a preform of a valve body of a hollow valve, comprising the following steps:

providing a workpiece and a forming punch;

inserting a powder comprising iron oxide or Ti—Fe as a protective coating between the workpiece and the forming punch; and compressive forming of the workpiece with the forming punch and the powder therebetween for creating said preform.

2. The method according to claim 1, wherein prior to inserting the protective coating, a step of generating a cavity in the workpiece is performed, into which cavity the protective coating is inserted.

3. The method according to claim 2, wherein the step of generating the cavity and/or compressive forming is performed by means of a hot forming process.

4. The method according to claim 1, including heating the powder to 1050-1200° C.

5. The method according to claim 1, wherein the powder or a powder combination is effective for increasing the cooling effect of a valve plate bottom of the valve body, which combines with the valve plate bottom to form a cooling layer.

6. The method according to claim 1, wherein a valve stem and a valve head with a valve plate and a valve plate bottom is formed in a further method step, either by compressive forming or impact extrusion or forging.

7. The method according to claim 6, wherein a diameter of the valve stem is further reduced by necking, swaging, flow forming or axial feed transverse rolling of the preform with or without mandrel after spin extrusion in a further method step by cold, semi-hot or hot forming.

8. The method according to claim 1, wherein the workpiece is a blank or semi-finished product.

* * * * *